US009221163B2

(12) United States Patent
Wang et al.

(10) Patent No.: US 9,221,163 B2
(45) Date of Patent: Dec. 29, 2015

(54) NAIL GUIDER AND NAILING DEVICE HAVING THE SAME

(71) Applicant: APEX MFG. CO., LTD., Taichung Hsien (TW)

(72) Inventors: Jing-Li Wang, Taichung Hsien (TW); Rong-Yu Wang, Taichung-Hsien (TW)

(73) Assignee: APEX MFG. CO., LTD., Tali, Taichung Hsien (TW)

( * ) Notice: Subject to any disclaimer, the term of this patent is extended or adjusted under 35 U.S.C. 154(b) by 171 days.

(21) Appl. No.: 14/193,724

(22) Filed: Feb. 28, 2014

(65) Prior Publication Data

US 2014/0175145 A1 Jun. 26, 2014

Related U.S. Application Data

(63) Continuation-in-part of application No. 13/213,661, filed on Aug. 19, 2011, now abandoned.

(30) Foreign Application Priority Data

Aug. 20, 2010 (TW) ..... 99127890

(51) Int. Cl.
*B25C 5/06* (2006.01)
*B25C 5/16* (2006.01)

(52) U.S. Cl.
CPC ..... *B25C 5/06* (2013.01); *B25C 5/1637* (2013.01)

(58) Field of Classification Search
CPC ..... B25C 5/06
USPC ..... 227/8, 120, 104, 119, 109, 136, 139, 227/123
See application file for complete search history.

(56) References Cited

U.S. PATENT DOCUMENTS

| | | | | |
|---|---|---|---|---|
| 3,834,602 | A | 9/1974 | Obergfell | |
| 5,692,665 | A | 12/1997 | Lee | |
| 5,873,509 | A * | 2/1999 | Liao | B25C 1/005 227/109 |
| 7,059,507 | B2 | 6/2006 | Almeras et al. | |
| 7,086,573 | B1 * | 8/2006 | Wen | B25C 1/008 227/120 |

* cited by examiner

*Primary Examiner* — Nathaniel Chukwurah
(74) *Attorney, Agent, or Firm* — Muncy, Geissler, Olds & Lowe, P.C.

(57) ABSTRACT

The present invention provides a nail guider including a guiding board, at least an assisting member. The guiding board positioned in front of the nail track vertically has a first surface and a second surface. The first surface faces the nail track. The guiding board has at least a vertical penetrating slot thereon. The penetrating slot penetrates the first surface and the second surface of the guiding board. The assisting member includes an assisting end and a pushing end, slides forwardly and backwardly in the penetrating slot. The assisting end protrudes out of the first surface selectively, and the pushing end is located at the second surface. The assisting member used for straightening up nails further comprises at least an assisting surface parallel to the nailing track. The pushing end can be pushed so that the assisting surface can assist and straighten up nails.

10 Claims, 6 Drawing Sheets

NAIL GUIDER AND NAILING DEVICE HAVING THE SAME

FIELD OF THE INVENTION

The present invention is a CIP of application Ser. No. 13/213,661, filed Aug. 18, 2011, the entire contents of which are hereby incorporated by reference.

BACKGROUND OF THE INVENTION

Description of the Prior Art

Conventional nailing devices use a striking board for striking nails so that the nail could be nailed into a target. Among conventional nailing devices, some of them would be disposed with a nail guider in front of a nail track so that the nail would be hit out vertically or the nail would not stock the nail track because of being crooked. As such, the nail can keep standing vertically before being hit out with the help of the nail guider.

As the U.S. Pat. No. 5,692,665 mentioned, a nail guider is disclosed. In the FIG. 1 of the patent, the two guiding feet 8, 9 can use elasticity for pivoting to the front of the nail track selectively. Thus, the nail is straightened up. Besides, as shown in FIG. 3, the composition method of the two guiding feet 52, 62 is replaced by using a fulcrum 33. Also, the nail guider uses the elastic slice 70 for abutting and pushing the two guiding feet 52, 62 so that the two guiding feet 52, 62 would pivot toward a direction of the nail track.

As the U.S. Pat. No. 7,086,573 mentioned, it discloses a braking unit for nail drivers, in which the retaining unit 2 is blocked by the end board (the member disposed around the nails 4) and cannot be urged to penetrate through the opening of the end board and none of parts of the retaining unit 2 can be protrusive out of the surface of the end board, so that the retaining unit 2 can not function to assist the nails 4. The function of the retaining unit 2 is used to sense if an unused nail 4 exists in the punch channel 13, and is not to assist the nail 4. Specially, the contact face 261 of the second cam 26 can be inserted into the punch channel 13 and sense any nail 4 in a nail driver, then restrain and release the securing slide rod. Obviously the second cam 26 of the retaining unit 2 is not used to assist and straighten up the nail 4. Moreover, the second cam 26 just contact the top end of the nail by rotating an angular displacement corresponding to the nail 4, if there is no any nail, then the second cam 26 will stop rotating. Therefore, the retaining unit 2 can not assist and straighten up the nail 4 at all.

In other words, the guiding feet of the conventional nail guiders is designed to pivot. The disadvantage of the design is that the guiding feet would be tilting when straightening the nail up. As a result, a lateral side of the nail could not be completely straightened up, and a force could not distribute on the nail evenly as well. Thus, the function of the nail guider would be influenced.

Further, As the U.S. Pat. No. 5,873,509 mentioned, it discloses that the guide plate 33 is blocked by the end board 20 and cannot be urged to penetrate through the elongate opening 21 and none of parts of the guide plate 33 can be protrusive out of the surface of the end board 20 (FIG. 4), so that the guide plate 33 can not function to assist the lead nail 60. The guide plate 33 is just to lead the lead nail 60 and then the lead nail 60 can receive in the area of the received portion 31, while the lead nail 60 slopes in the groove, the guide plate 33 still leads the nail 60 to the received portion 31 without the function of assisting and straightening obviously. Therefore, the guide plate 33 is not mentioned to assist and straighten up the lead nail 60 at all.

Besides, in the conventional nail guider, the assisting member for the nails is not normally located within the through slot, the top and bottom faces of the assisting member do not closely parallel and correspond respectively to the upper and lower faces of the through slot, so that at least one connecting member (such as a pivot, pin or the like as disclosed in U.S. Pat. No. 7,086,573 or U.S. Pat. No. 5,873,509) is required to limitedly connect the assisting member and a fixation board of the nailing device. As a result, the conventional structure is complicated, and the assisting member can move linearly and operate stably without the help of the connecting member. Moreover, since the conventional structure is formed with merely with a single protrusion, single recess or the like (as disclosed in U.S. Pat. No. 7,086,573 or U.S. Pat. No. 5,873,509) on single base member for installation of a spring, the spring can dismount from the base member easily.

SUMMARY OF THE INVENTION

The main object of the present invention is to provide a nail guider capable of straightening lateral sides of nails completely.

To achieve the above, the present invention provides a nail guider to be disposed in a nailing device, and the nailing device comprises a nail track. The nail guider is disposed in front of the nail track. The nail guider comprises a guiding board, at least an assisting member and a pushing means. The guiding board, positioned in front of the nail track vertically, has a first surface and a second surface, and the first surface is opposite to the second surface. The first surface faces the nail track, and the guiding board has at least a vertical penetrating slot thereon.

The penetrating slot penetrates the first surface and the second surface of the guiding board. The assisting member can slide forwardly and backwardly in the penetrating slot, and the assisting member has an assisting end and a pushing end. The assisting end protrudes out of the first surface selectively and the pushing end is located at the second surface. The assisting member further comprises at least an assisting surface parallel to the nailing track. In other words, the assisting surface is located at two sides of the assisting end, and the assisting surface is used for straightening up nails. As such, the assisting end has a tendency of protruding out of the first surface.

In conclusion, speaking of a former disadvantage that nail guiders with pivoting design disables nails to be supported with even force, so a feature that the assisting member can straightly slide along a horizontal direction improves the former disadvantage. Thus, the assisting member keeps straightening the nail up in a vertical moving process of the striking board, so the nails would not be crooked or stocked when being stroke by the striking board. The working efficiency of the nailing device is enhanced as well.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
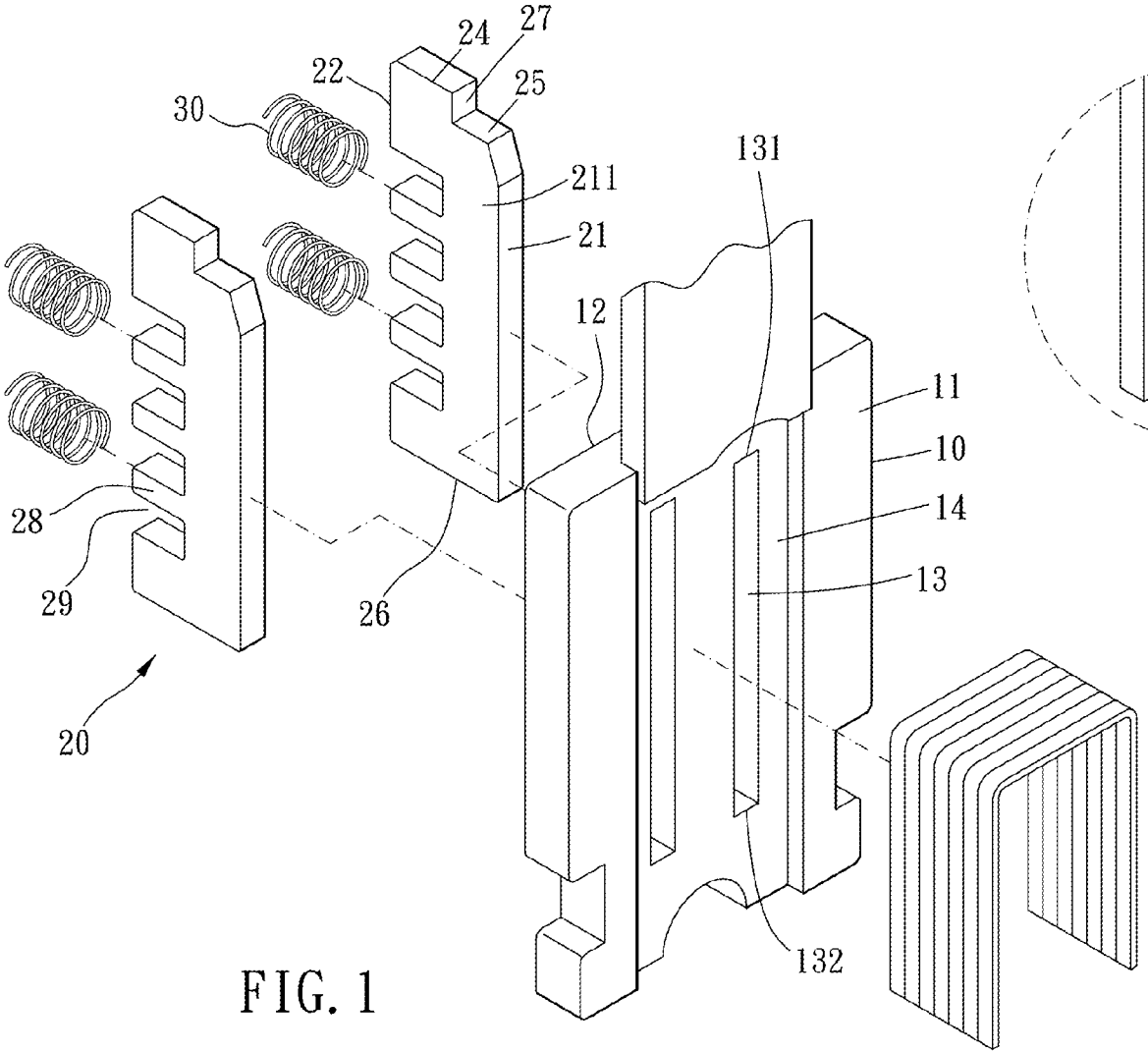
FIG. 1 is a decomposition drawing of the present invention.
Figure 2:
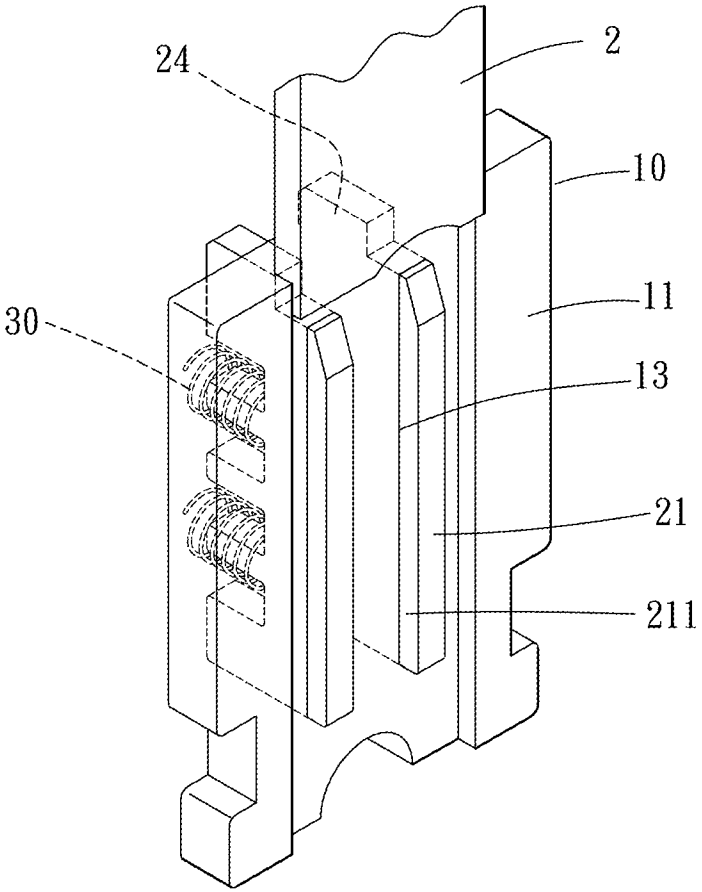
FIG. 2 is a stereogram of the present invention.

Please refer to FIG. 1 and FIG. 2, the nail guider is used for being disposed in a nailing device comprising a nail track, and the nail guider positioned in front of the nail track. The nail guider comprises a guiding board 10, at least an assisting member 20 and a pushing means.

The guiding board 10, positioned in front of the nail track vertically, has a first surface 11 and a second surface 12, and the first surface 11 is opposite to the second surface 12. The first surface 11 faces the nail track, and the guiding board 10 has at least a vertical penetrating slot 13 thereon. In a preferred embodiment of the present invention, the guiding board 10 has two vertical penetrating slots 13 thereon. The penetrating slot 13 penetrates the first surface 11 and the second surface 12 of the guiding board 10. To increase more perfection to the nail guider of the present invention, the first surface 11 of the guiding board 10 has a guiding slot 14 extending vertically, and the guiding slot 14 is used for guiding a striking board 2 or a nail sliding along the guiding slot 14 vertically.

The assisting member 20 corresponds to the penetrating slot 13, and the assisting member 20 is inserted in the penetrating slot 13. The assisting member 20 can slide forwardly and backwardly in the penetrating slot 13, and the assisting member 20 has an assisting end 21 and a pushing end 22. The assisting end 21 protrudes out of the first surface 11 selectively, and the pushing end 22 is located at the second surface 12. The assisting member 20 further comprises at least an assisting surface 211 parallel to the nailing track. In other words, the assisting surface 211 is located at two sides of the assisting end 21, and the assisting surface 211 is used for straightening up nails.

The pushing means is for pushing the pushing end 22 elastically, for causing the assisting end having a tendency of protruding out of the first surface 11, wherein the pushing means contacts and pushes the pushing end 22 and urges the assisting member 20 to penetrate through the penetrating slot 13 where the assisting end 22 is retractably protrusive out of the first surface 11. In the preferred embodiment of the present invention, the pushing means comprises at least one pair of springs 30 (or at least two springs) corresponding to the assisting member 20, and the pair of the springs 30 is horizontally positioned and vertically arranged to push the assisting member 20. As such, a forcing power is evenly distributed to the assisting member 20 so that the assisting member 20 can move in a horizontal direction smoothly. In the preferred embodiment of the present invention, the pushing end 22 is in a structure of battlements with plural convex blocks and concave slots. Each of the springs 30 is disposed around one of the convex blocks. Moreover, the assisting member 20 can further comprise a stopping portion 24 to prevent the assisting member 20 from sliding out of the penetrating slot 13 completely. The stopping portion 24 is close to the second surface 12, and a position of the stopping portion 24 is over a contour of the penetrating slot 13. The stopping portion 24 abuts against the guiding board 10 to reach an effect of limiting a position of the assisting member 20, making the assisting member 20 protrude out of the first surface 11 correctly and preventing the assisting member 20 from completely sliding out of the penetrating slot 13 when the assisting end 21 protrudes out of the first surface 11.

Preferably, the penetrating slot 13 has an upper flat guiding face 131 and a lower flat guiding face 132 opposite to each other, the assisting end 21 has an upper flat guided face 25, a lower flat guided face 26 opposite to the upper flat guided face 25 and a stopping face 27 extending upwardly from the upper flat guided face 25. The assisting end 21 is normally located within the penetrating slot 13, and the upper and lower flat guided faces 25, 26 are closely parallel and correspond respectively to the upper and lower flat guiding faces 131, 132. The stopping face 27 abuttably faces the second surface 12 of the guiding board 10, wherein the stopping portion 24 is provided with the stopping face 27 and the stopping portion 24 is located beyond a contour of the penetrating slot 13. The stopping portion 24 and the assisting end 21 form a stepped structure, wherein the stopping face 27 is substantially perpendicular to the upper flat guided faces 25. The assisting end 21 moves linearly along and through the penetrating slot 13 and is stopped when the stopping face 27 abuts against the second surface 12.

Alternatively, the assisting member 20 further comprises at least two spaced legs 28 at the pushing end 22 and recesses 29 formed adjacent to the at least two legs 28, and the pushing means comprises at least two springs 30 correspondingly disposed respectively around the two legs 28 and into the recesses 29. The two springs 30 are horizontally positioned and vertically arranged to push the assisting member 20. The assisting member 20 is limitedly retractably held only by the guiding board 10 and the two springs 30 without any other connection which is limitedly connected to the assisting member 20 and a fixation board 40 of the nailing device. In other words, the assisting member 20 is free respective to the fixation board 40 and in a normally biased state due to urging abutment of the two springs 30 against the assisting member 20 and the fixation board 40.

Since the assisting end 21 is normally located within the penetrating slot 13, the upper and lower flat guided faces 25, 26 are closely parallel and correspond respectively to the upper and lower flat guiding faces 131, 132, the assisting member 20 is limitedly retractably held only by the guiding board 10 and the two springs 30, and the stopping face 27 can abut against the second surface 12 appropriately, so none of any other connection (such as a pivot, pin, linkage, arm or the like as disclosed in U.S. Pat. No. 7,086,573 or U.S. Pat. No. 5,873,509) is required to limitedly connect the assisting member 20 and the fixation board 40 of the nailing device. As a result, the structure is simple, and the assisting member 20 can move linearly and operate stably.

Furthermore, since the two springs 30 are correspondingly disposed respectively around the two legs 28 and into the recesses 29, thus effectively preventing dismounting of the spring 30 and ensuring normal working of the nail guider and not requiring any positioning/or mounting structure (such as a single protrusion, single recess or the like as disclosed in U.S. Pat. No. 7,086,573 or U.S. Pat. No. 5,873,509) for installation of a spring.

Figure 4:
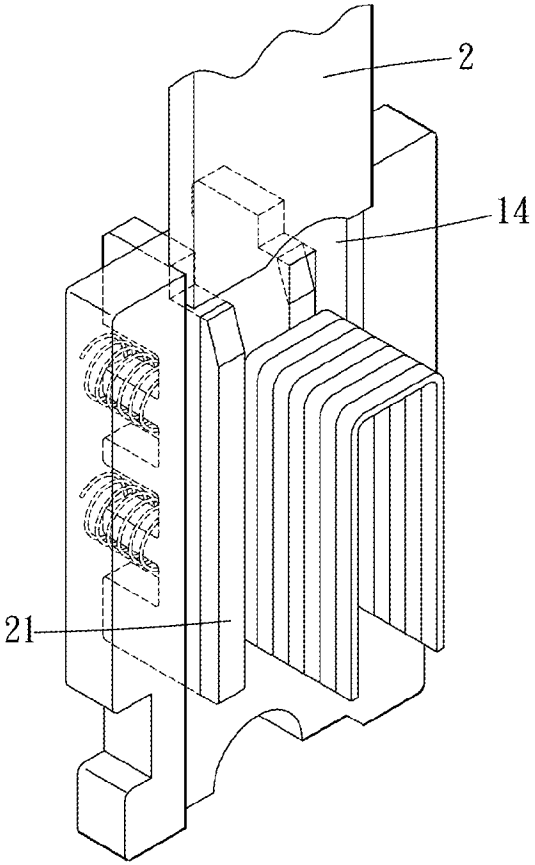
FIG. 4 is a schematic drawing showing a second embodiment of the present invention.
Figure 3:
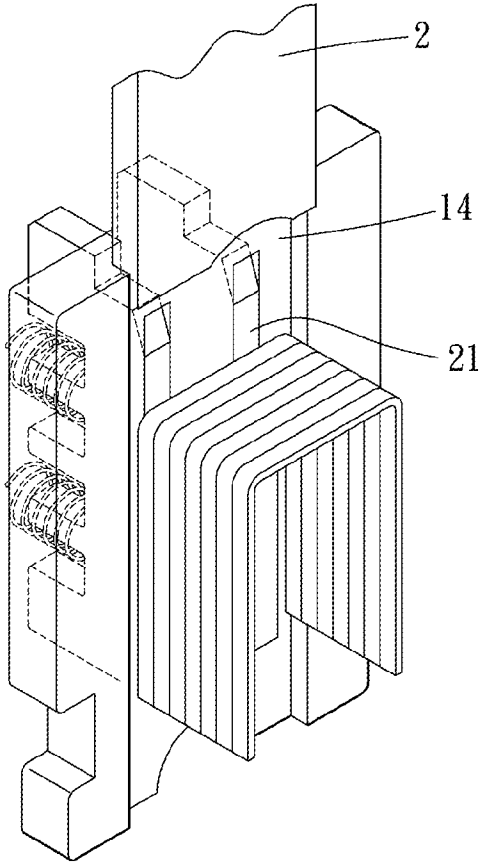
FIG. 3 is a schematic drawing showing a first embodiment of the present invention.

As shown in FIG. 3 and FIG. 4, the nail guider of the present invention can be adapted to be used with nails of various sizes. For instance, in FIG. 3, because the breadth of the nail is wider, the two assisting member 20 can be pushed toward a direction away from the nail track with being straightened up by lateral sides of the guiding slot 14. However, in the FIG. 4, because the breadth of the nail is narrower, one of the two assisting member 20 can offer the assisting surface 211 for the nail to abut. As such, the nail can still be straightened up. Surely, in other possible embodiments of the present invention, the nail guider can be adapted to be used with nails of various types such as U-shaped nails and I-shaped nails.

Figure 6A:
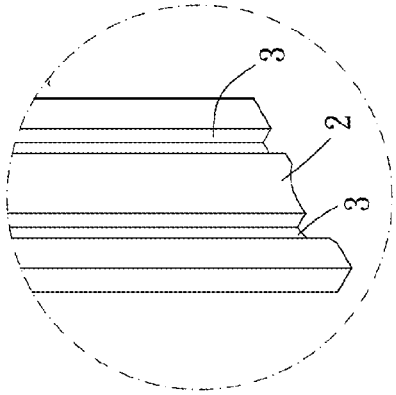
FIG. 6A is a schematic drawing of a striking board of the present invention.
Figure 5:
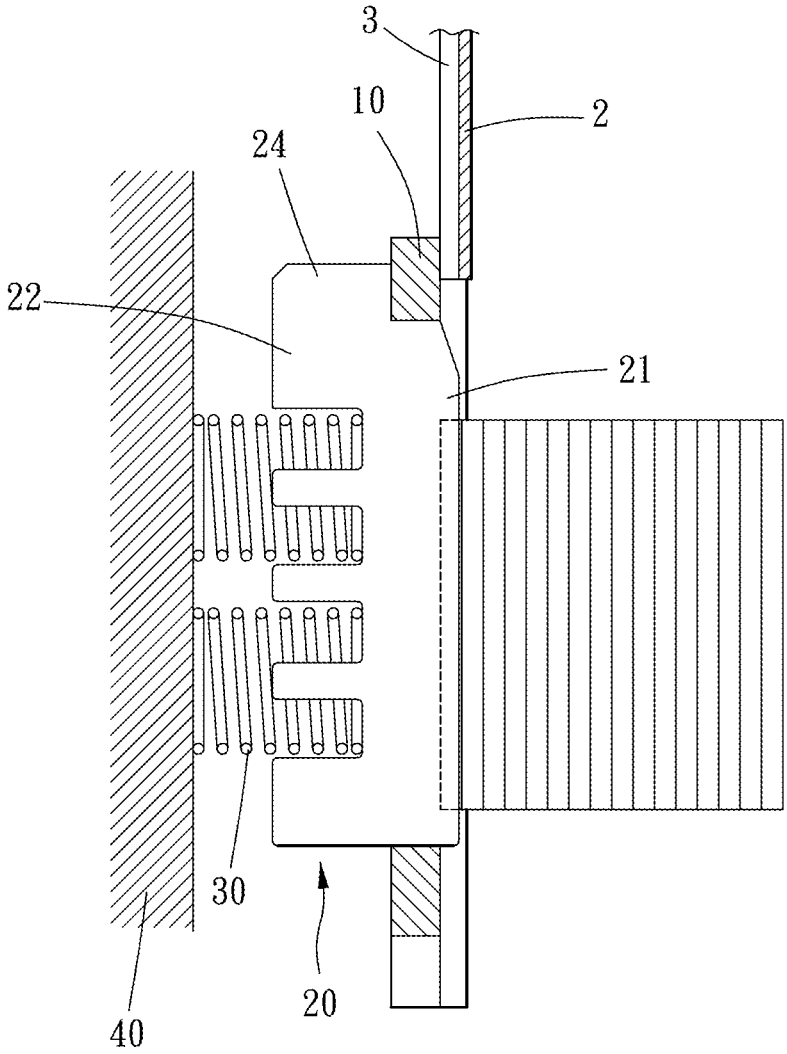
FIG. 5 is a cross-sectional drawing showing an operating condition of the first embodiment of the present invention.
Figure 6:
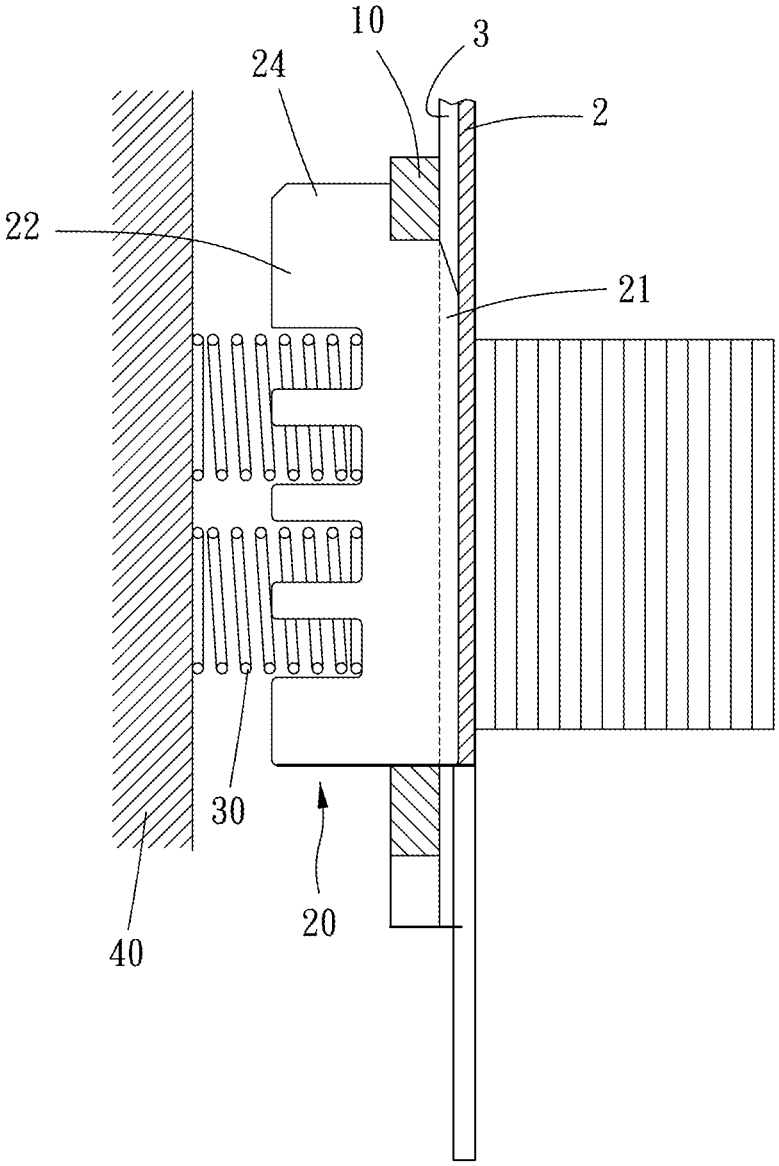
FIG. 6 is a cross-sectional drawing showing an operating condition of the second embodiment of the present invention.

Please refer to FIG. 5, the assisting member 20 can abut against a lateral side of the nail to straighten the nail up when the nail is ready to be strike out. And as shown in FIG. 6, the striking board 2 moves downwardly when a striking operation is started up. As shown in FIG. 6A, the striking board 2 has an inner side facing the first surface 11 of the guiding board 10, and the inner side has at least one slot 3 corresponding to the assisting member 20. When the assisting end 21 protrudes out of the first surface 11, the assisting end 21 is located in the slot 3. Because the assisting member 20 can keep straightening the nail up in an up-and-down moving process of the striking board 2, the assisting member 20 can lead the nail to be stroke out vertically. And the striking operation is finished.

Figure 7:
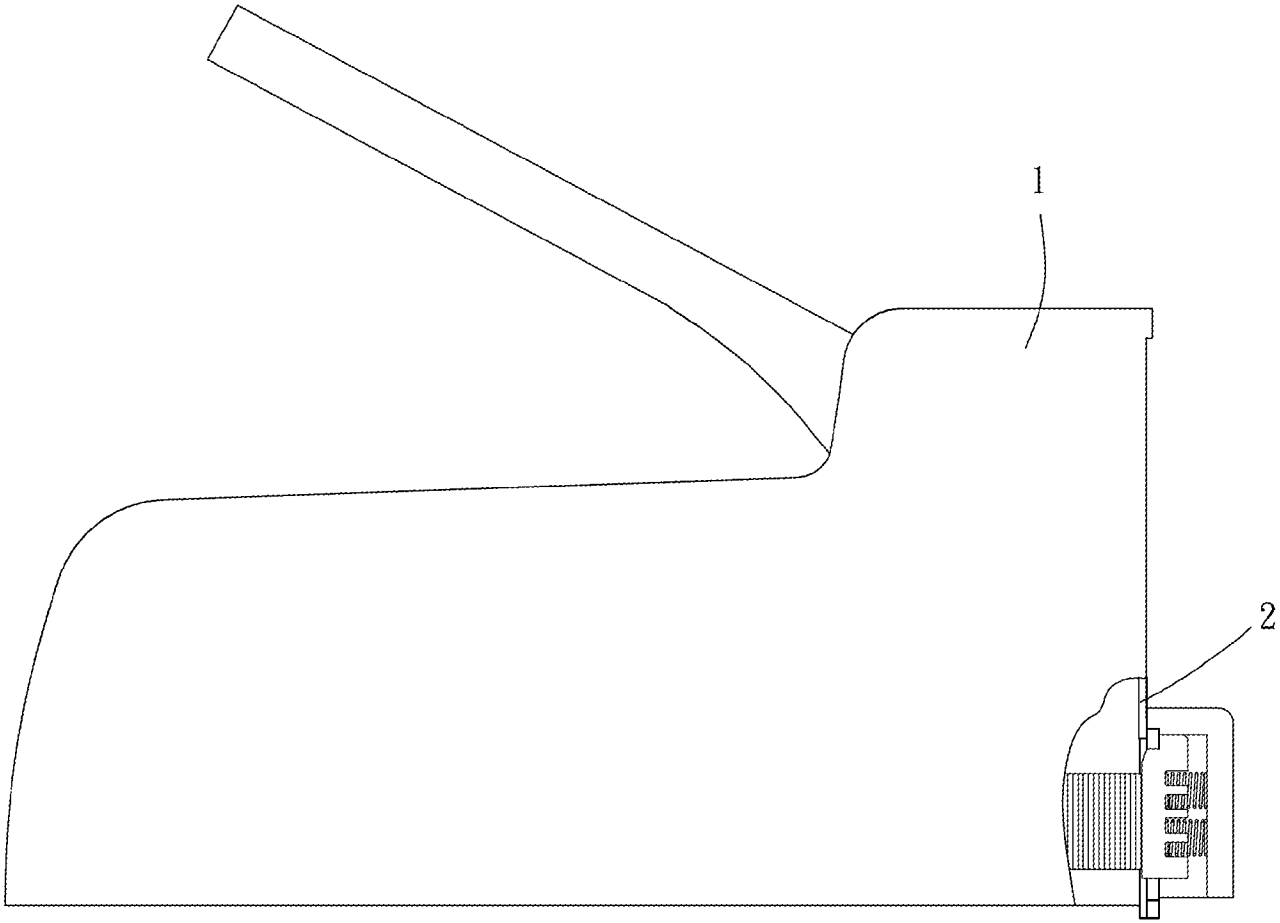
FIG. 7 is a schematic drawing of a nailing device of the present invention.

Furthermore, as shown in FIG. 7, the nailing device of the present invention includes the nail guider described above, the nail track, the striking board 2 and a shell 1. The shell 1 is used for containing the components mention above therein. The nail track is used for straightening nails up and driving the nails slide along an extending direction of the nail track. The striking board 2 strikes the nails out selectively.

The nail guider of the present invention enables the assisting member to evenly support on lateral sides of the nails by a feature that the assisting member can straightly slide along a horizontal direction. Thus, speaking of a former disadvantage that the nail guider with pivoting design disables the nail to be supported with even force, the nail guider of the present invention improves the former disadvantage. Moreover, the striking board has slots for containing the assisting end, so the assisting member can keep straightening the nail up in a vertical moving process of the striking board. Therefore, the nails would not be crooked or stocked when being stroke by the striking board.

What is claimed is:

1. A nail guider, used for being disposed in a nailing device with a nail track and positioned in front of the nail track, the nail guider comprising:

a guiding board, positioned in front of the nail track vertically, having a first surface and a second surface, the first surface being opposite to the second surface, the first surface facing the nail track, the guiding board having at least a vertical penetrating slot thereon, the penetrating slot penetrating the first surface and the second surface of the guiding board;

at least an assisting member, the assisting member corresponding to the penetrating slot, the assisting member being inserted in the penetrating slot, the assisting member can slide forwardly and backwardly in the penetrating slot, the assisting member having an assisting end and a pushing end, the assisting end protruding out of the first surface selectively, the pushing end being located at the second surface, the assisting member further comprising at least an assisting surface, the assisting surface being parallel to the nailing track, the assisting surface being used for straightening up nails; and a pushing means for pushing the pushing end elastically, for causing the assisting end having a tendency of protruding out of the first surface;

wherein the penetrating slot has an upper flat guiding face and a lower flat guiding face opposite to each other, the assisting end has an upper flat guided face, a lower flat guided face opposite to the upper flat guided face and a stopping face extending upwardly from the upper flat guided face, the assisting end is normally located within the penetrating slot, the upper and lower flat guided faces are closely parallel and correspond respectively to the upper and lower flat guiding faces, the stopping face abuttably faces the second surface of the guiding board, the assisting end moves linearly along and through the penetrating slot and is stopped when the stopping face abuts against the second surface.

2. The nail guider of claim 1, wherein the assisting member further comprises at least two spaced legs at the pushing end and recesses formed adjacent to the at least two legs, the pushing means comprises at least two springs correspondingly disposed respectively around the two legs and into the recesses, the two springs are horizontally positioned and vertically arranged to push the assisting member.

3. The nail guider of claim 1, wherein the assisting member further comprises a stopping portion, the stopping portion is provided with the stopping face, the stopping portion is located beyond a contour of the penetrating slot, the stopping face abuts against the guiding board to reach an effect of limiting a position of the assisting member, making the assisting member protrude out of the first surface correctly and preventing the assisting member from completely sliding out of the penetrating slot when the assisting end protrudes out from the first surface.

4. The nail guider of claim 1, wherein the first surface of the guiding board has a guiding slot extending vertically, the guiding slot is used for guiding a striking board or a nail sliding vertically along the guiding slot.

5. The nail guider of claim 1, wherein the assisting member further comprises at least two spaced legs at the pushing end and recesses formed adjacent to the at least two legs, the pushing means comprises at least two springs correspondingly disposed respectively around the two legs and into the recesses, the two springs are horizontally positioned and vertically arranged to push the assisting member, and the assisting member is limitedly retractably held only by the guiding board and the two springs without any other connection which is limitedly connected to the assisting member and a fixation board of the nailing device.

6. A nailing device, comprising the nail guider of claim 1, the nail track, a striking board and a shell, wherein the nail guider, the nail track, and the striking board is disposed in the shell, the nail track has an extending direction, the nail track is used for supporting the nail to lead the nail moving along the extending direction, the striking board is used for striking the nail out selectively.

7. The nailing device of claim 6, wherein the striking board can move upwardly and downwardly along the first surface of the guiding board, the striking board has an inner surface facing the first surface of the guiding board, the inner surface has at least a sinking slot corresponding to the assisting member, the assisting end is located in the sinking slot when the assisting end protrudes out of the first surface.

8. The nailing device of claim 6, wherein the pushing means comprises at least two springs corresponding to the assisting member, the two springs are horizontally positioned and vertically arranged to push the assisting member.

9. The nailing device of claim 6, wherein the assisting member further comprises a stopping portion, the stopping portion is provided with the stopping face, the stopping portion is located beyond a contour of the penetrating slot, the stopping portion abuts against the guiding board to reach an effect of limiting a position of the assisting member, making the assisting member protrude out of the first surface correctly and preventing the assisting member from completely sliding out of the penetrating slot when the assisting end protrudes out from the first surface.

10. The nailing device of claim 6, wherein the first surface of the guiding board has a guiding slot extending vertically, the guiding slot is used for guiding a striking board sliding vertically along the guiding slot.

* * * * *